United States Patent [19]

Ray, Jr.

[11] 4,017,866

[45] Apr. 12, 1977

[54] LOG SEQUENTIAL ANTENNAS

[75] Inventor: Homer A. Ray, Jr., Dallas, Tex.

[73] Assignee: Continental Electronics Manufacturing Co., Dallas, Tex.

[22] Filed: June 19, 1975

[21] Appl. No.: 589,155

[52] U.S. Cl. ..... 343/792.5; 343/834; 343/846

[51] Int. Cl.[2] ..... H01Q 11/10

[58] Field of Search ..... 343/834, 835, 839, 843, 343/846, 792.5

[56] References Cited

UNITED STATES PATENTS

| | | | |
|---|---|---|---|
| 3,221,330 | 11/1965 | Berry | 343/792.5 |
| 3,483,563 | 12/1969 | Schroeder | 343/835 |
| 3,611,399 | 10/1971 | Rocke | 343/834 |

*Primary Examiner*—David C. Nelms
*Attorney, Agent, or Firm*—Nolte and Nolte

[57] ABSTRACT

A log sequential antenna is provided which has a unique configuration which allows for a plurality of different feed antenna systems to use an adjustable single slanted reflector screen with its lower end attached to the ground and primary ground reflection to illuminate the screen thus requiring only a single colinear line of feed dipoles. The unique features of the antenna disclosed take advantage of the best features of the prior art antennas while overcoming the limitations of such.

7 Claims, 12 Drawing Figures

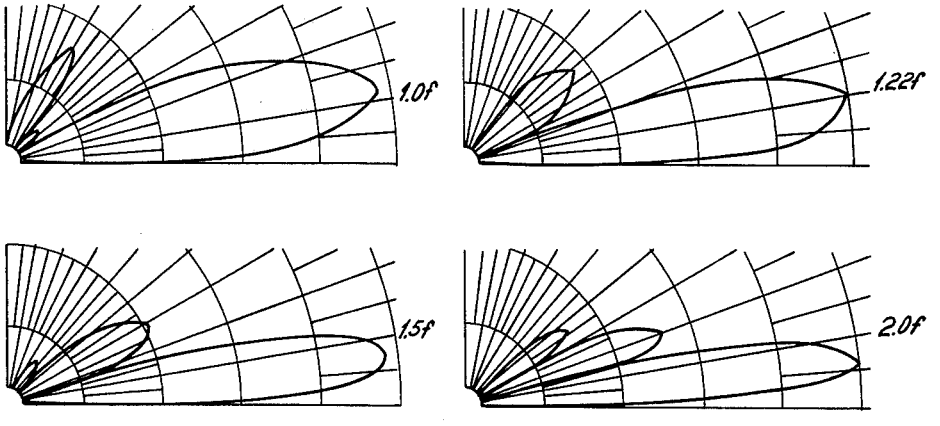
(PRIOR ART)
FIG. 5
FIG. 6
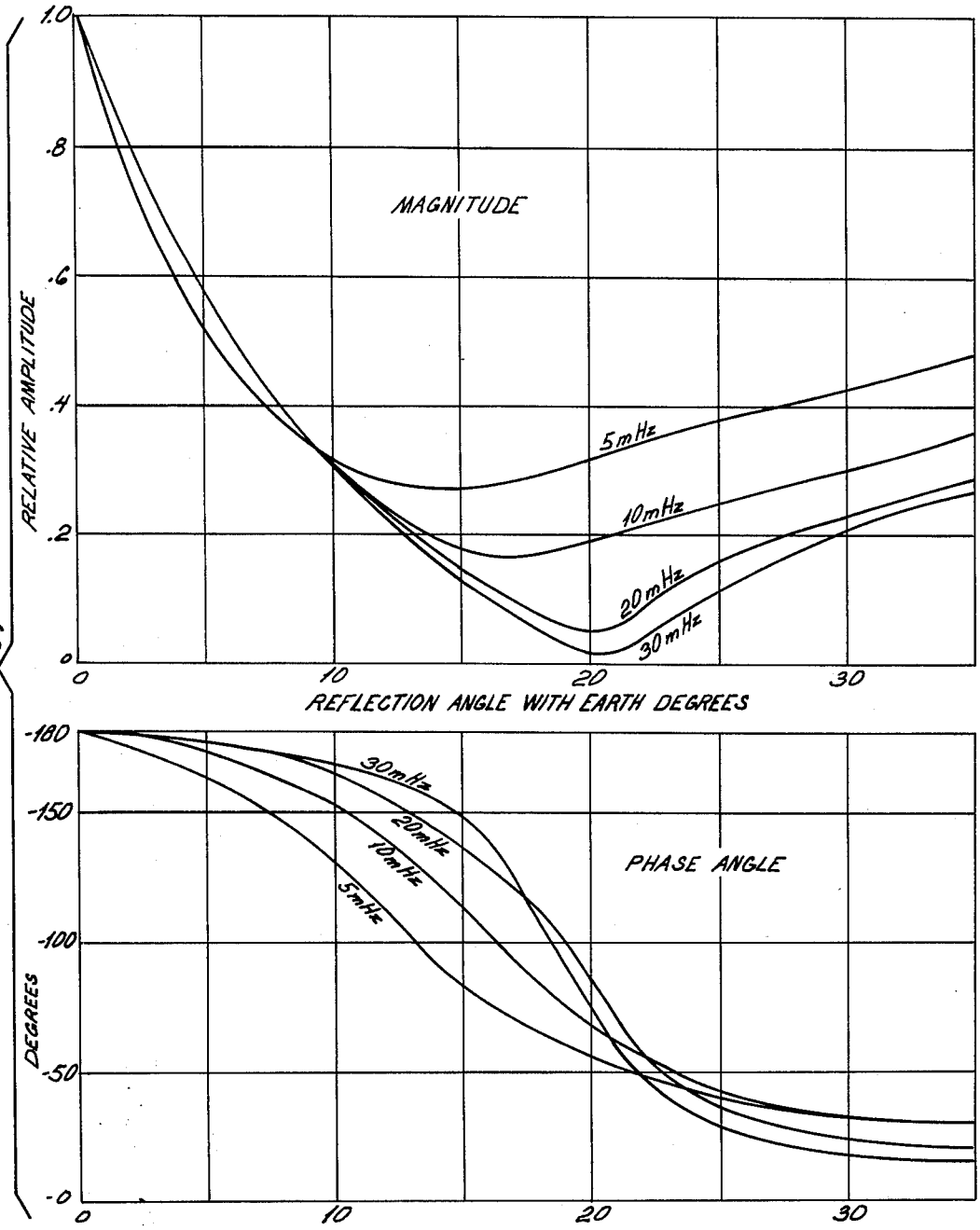

LOG SEQUENTIAL ANTENNAS

BACKGROUND OF THE INVENTION

A. Field of the Invention

This invention relates to antennas for high frequency broadcasting and for communication systems.

B. Prior Art

When considering antennas for high frequency broadcasting and communication systems there are a few basic types which have been in use for many years. Normally a directional antenna is desired since the target area often includes a single language speaking country or the circuit is a point-to-point communications path. The directional antenna conserves energy and concentrates the total transmitter power in the desired direction or area. The width of the beam and the resulting power gain are closely related in the following way:

| | | | | | |
|---|---|---|---|---|---|
| Beam width | 90 | 60 | 30 | 10 | Degrees |
| Power gain | 30 | 45 | 90 | 275 | Ratio-to-one |
| Gain | 15 | 17 | 20 | 24 | dBI |

These are nominal values and vary somewhat with the vertical beam width and magnitude of the side lobes.

The most used antenna for international broadcasting is the 16 element curtain antenna stacked four high and four wide using half wave dipoles in front of a reflector screen. It is a good antenna to use as a standard for comparison of all other types. The principle concern is how many antennas are required to cover the frequency range from approximately 5 to 30 MHz and consequently the total cost of the system.

The bandwidth of the curtain antenna is limited both by its impedance bandwidth and its radiation pattern bandwidth. Classic curtain antennas, such as the Voice of America Type IIC, are used over two adjacent international bands or a frequency ratio of 1.3:1. With improved dipole design, the ratio can be increased to 1.5:1. Beyond that point, there is no need for further improvements to the impedance bandwidth as the pattern bandwidth is restricted to that range. As will be illustrated further in the figures, if a beam of a curtain antenna is set to a useful angle of 10° or 12° at the low frequency end of its range, then as the frequency is increased the pattern becomes multilobed, it moves downward and its performance in gain and multipath interference deteriorates rapidly. Nothing further can be done to improve the pattern performance since it is a function of the physical height of the antenna array above the ground. These facts are all well documented in classical antenna literature. For a 1.5:1 range, a minimum of four curtains are required to cover from 5 to 25 MHz and preferably five are used for good performance.

Another type of antenna that has been used is the Rhombic. The impedance bandwidth of a terminated Rhombic is unlimited. Its pattern bandwith, however, has the same limitations as curtain antenna arrays and for the same reasons. Very long Rhombics tend to control the over-hanging lobes a little better than curtains and have been used over a 2:1 frequency ratio for economy. If the leg lengths are in excess of 5 wavelengths, it is not necessary to terminate the far end of the Rhombic with a load resistor since the reflection coefficient is largely radiated before it returns to the input terminals and the impedance excursions are consequently small. Four large Rhombics can be used to cover the frequency range with good performance but require a considerable amount of real estate.

The log periodic antenna, which has also been used, is like the Rhombic because it can be designed for a low impedance bandwidth over an unlimited frequency range and thus its impedance bandwidth is unlimited. When we consider pattern bandwidth, several types of log periodic antennas must be described. For example, a horizontal log periodic antenna has exactly the same pattern bandwidth limitation as the Curtain and Rhombic antennas and for the same reasons. It is possible to design a steeply sloping horizontal log periodic antenna wherein each of its elements has constant electrical height above the ground. This will produce a constant pattern over any frequency range, but the pattern has one high angle lobe good for short distance transmission only. It cannot be used for long range work.

Vertically polarized log periodic antennas have been in use to overcome the pattern deficiency of horizontal log periodics. However, while the pattern bandwidth is unlimited, it is not necessarily what is desired unless a very extensive ground system is used for thousands of feet out in front of the array. Low angle summation of the incident and ground reflected waves, as in-phase vectors, is based upon the assumption of a perfectly conductive earth. That is approximately true at medium and low frequencies, but at 5 MHz and above, it is far from true, as will be described in connection with the figures herebelow.

The reflection coefficient in this type of antenna is 180° out of phase at low angles for average soil conductivity from 5 to 30 MHz. Only above 20° does it become reasonably close to being in-phase, however at such high angles its magnitude has decreased to a small fraction of its value before the reflection due to dissipation in the soil. Thus, there is little or no radiation at low angles and at high angles there is up to 3 dB loss in the system, which means that one half the power is wasted in the earth. The only solution offered to this problem to date is to provide a ground screen out through the first fresnel zone which, for low angles is quite extensive. This requires a lot of copper, labor and real estate.

SUMMARY OF THE INVENTION

In the log sequential antenna of this invention, a single reflector screen, which is slanted with one end positioned on the ground, is provided which overlies at least one, and preferably a plurality, of dipoles which are colinear with each other and are spaced from one wavelength from the juncture of the reflector screen and the ground. Each of the plurality of feed antennas is located spaced from each other in log periodic steps. By slanting the screen and using a primary ground reflection to illuminate it, the log sequential antenna of this invention requires only a single colinear line of feed dipoles which allows for a separate feed system for each band of operation within a single array without physical overlap.

The log sequential antenna of this invention has the same fundamental limitations on its sub-system parts as does a curtain antenna, but its unique configuration allows a large number of different frequency feed systems to utilize the single slanted reflector screen which need be no bigger than the size required for the lowest frequency of operation.

The geometry of the log sequential antenna of this invention is described completely by angles, as is the case with log periodic arrays. This gives unlimited impedance bandwidth and it is switched sequentially for each band of operation to hold the radiation patterns constant with frequency change. It is the only known antenna which successfully covers the total frequency range in a single unit the size of an equivalent curtain antenna.

The single colinear feed is feasible since the system utilizes multiple images or reflections in the slanted screen which eliminates over-hanging or grating lobes in the vertical pattern.

One of the considerable advantages of the log sequential antenna of this invention is that there is no active feed element in the superstructure. All feed components are at a height of 0.2 wavelengths above the ground. In addition, the vertical angle of radiation can be steered by selecting the distance of the feed antenna system from the apex of the screen and the ground. Vertical angles from 8° to 22° may be selected for each or all frequencies throughout the operating range. Horizontal plane patterns thus produced can be held constant for the lowest frequency of design to any selected upper frequency limit.

Steering the horizontal plane pattern of the log sequential antenna of this invention is accomplished by means for phasing the feed system. With uniform power in all elements, the log sequential antenna will have equivalent horizontal plane pattern steering with an equivalent curtain antenna. With tapered illumination, both the log sequential antenna of this invention and curtain antennas can be steered to wide angles. Log periodic arrays have their sub-arrays converging inward to a point in front of the system. The sub-arrays are therefore not aligned on boresight and steering is restricted to smaller angles if side lobes are to be kept within reasonable bounds.

The log sequential antenna, therefore, is the only antenna with nominally constant impedance and pattern performance over the total frequency range. Its feed system is easily added to or modified in the event of changes in system's performance requirements and without effecting the superstructure of the slanted reflector screen. As stated before, it collects the best features of existing antennas and is the missing link between log periodic antennas and curtain antennas.

The log sequential antenna of this invention is novel in that it places one surface of a corner reflector antenna coincident with the earth and it is excited with a feed system very close to the earth.

The reflector screen can be set at any angle and the radiation analyzed by repositioning of the image antennas along with the number that are correspondingly produced. If the angle is 90° divided by an integer, the system of images is symmetrical. Otherwise, there is a residual wedge angle at the rear. With small corner angles, the beam angle of radiation moves downward towards the earth which is most desirable for long distance propagation of signals at high frequencies. This makes the log sequential antenna's adjustability more useful and suppresses high angle over-hanging lobes of radiation which produce multipath distortion common on some other types of antennas.

BRIEF DESCRIPTION OF THE DRAWINGS

FIG. 5 is a series of vertical plane patterns typical for curtain, Rhombic and horizontal log periodic antennas of the prior art;

FIG. 6 is a pair of graphs showing the reflection coefficient vertical polarization of prior art log periodic antennas;

DESCRIPTION OF THE PREFERRED EMBODIMENTS

Figure 1:
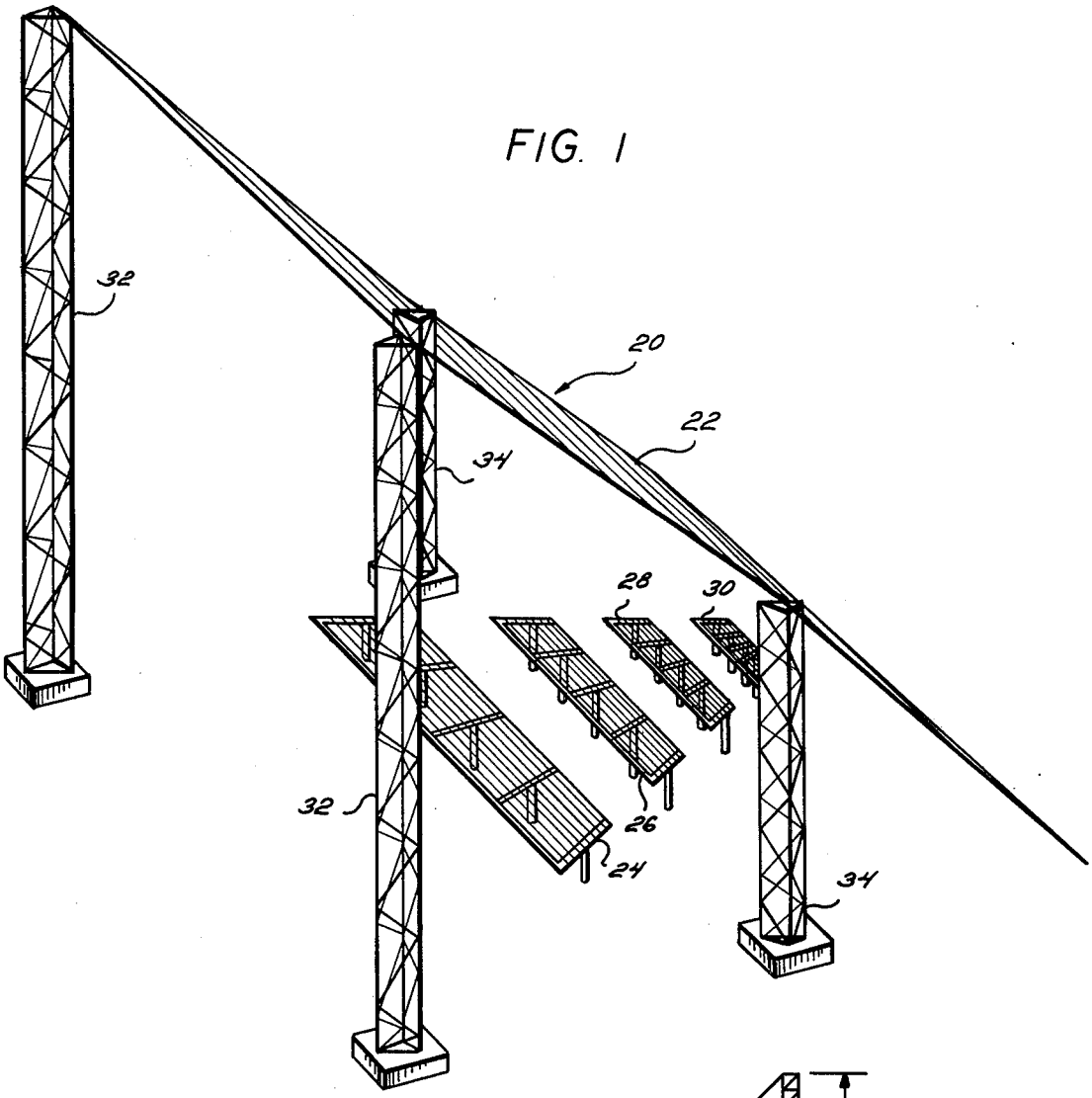
FIG. 1 is a perspective of a log sequential antenna array of this invention.
Figure 2:
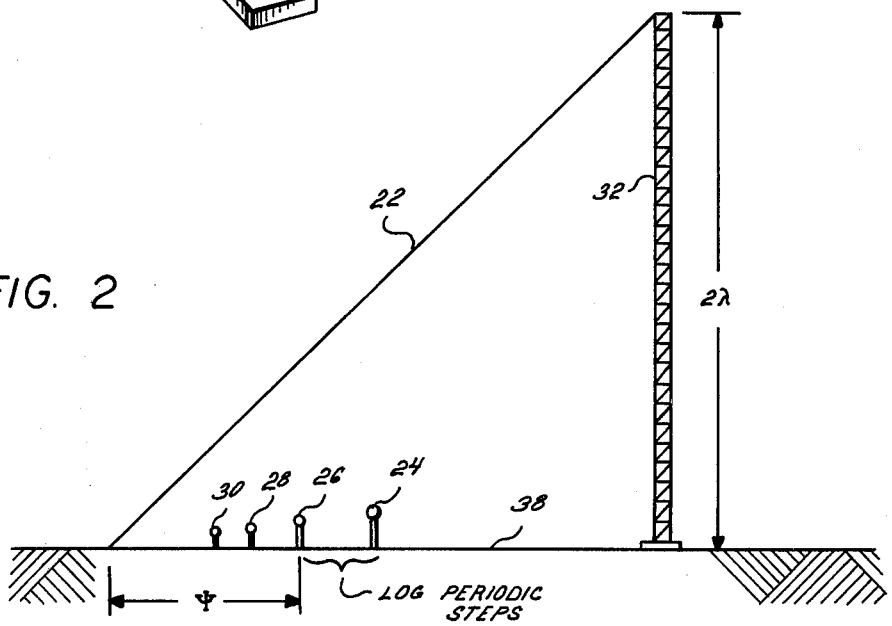
FIG. 2 is an elevation view of a typical log sequential antenna.
Figure 3:
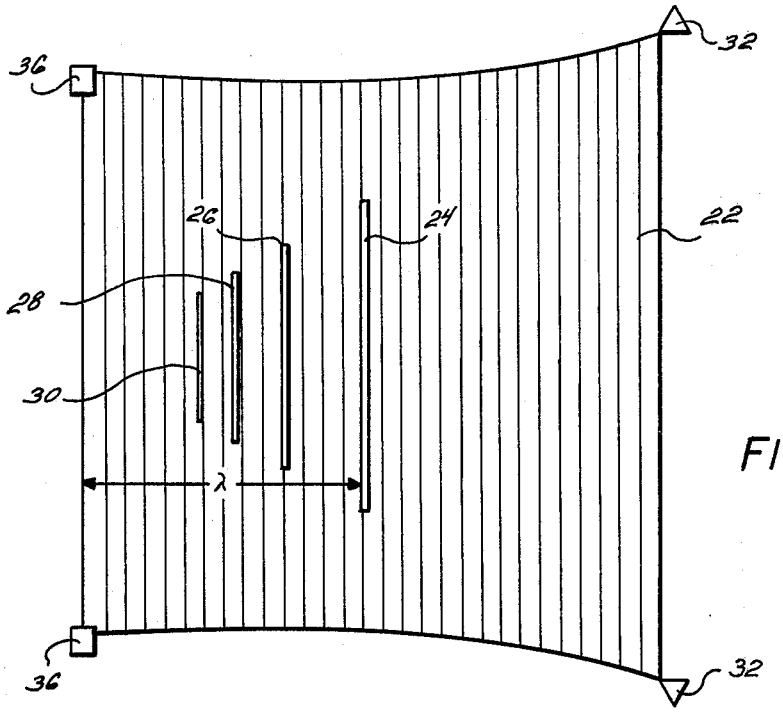
FIG. 3 is a plan view of a log sequential antenna of this invention.

FIGS. 1, 2 and 3, illustrate a typical log sequential antenna array, indicated generally at 20. The array 20 is made up of a slanted reflector screen 22 which overlies a plurality of radiation elements 24, 26, 28 and 30 as illustrated. Front towers 32 support the upper end of the screen 22 and optional supplementary towers 34 may be provided in the event that the weight of the screen is such that additional support is required in order to maintain the reflector screen 22 without appreciable sagging. While the supplementary towers 34 are illustrated in FIG. 1, in FIGS. 2 and 3 they are omitted. The lower end of the screen 22 is connected to the ground by means of anchors 36. The support towers preferrably include means (not shown) which permit the included angle between the screen 22 and ground 38 to be varied from approximately 8° to 45°.

The spacing between the dipoles or radiation elements 24, 26, 28, 30 is in log periodic steps and each is located 0.2 wavelengths above the ground 38 and 1 wavelength from the juncture of the screen 22 and the ground 38. As stated in the summary of the invention above, the single reflector screen 22 need be no bigger than the size required for the lowest frequency of operation. By slanting the screen 22 and using the ground 38 for primary reflection to illuminate the screen 22, the log sequential antenna 20 requires the illustrated single colinear line of feed dipoles 24, 26, 28, 30.

Figure 4:
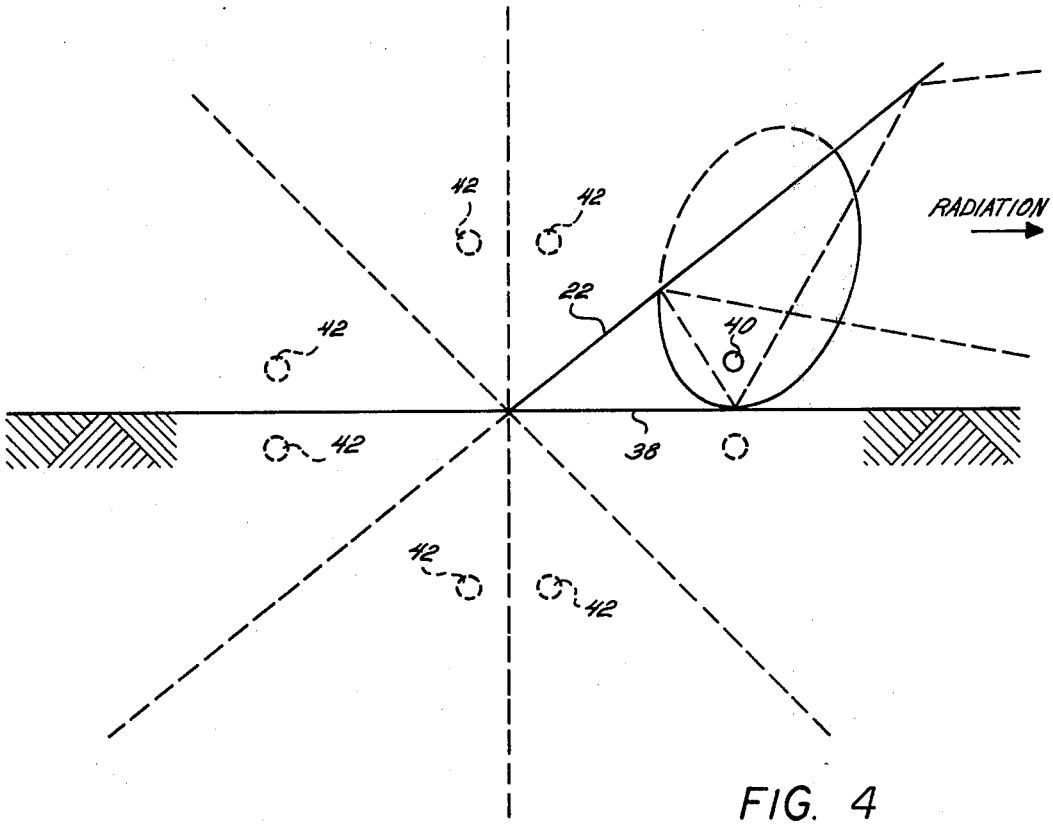
FIG. 4 is a diagram illustrating the radiating geometry of a log sequential antenna.

This allows a separate feed system for each band of operation within a single array without physical overlap. The feed to the radiation elements or dipoles 24, 26, 28, 30 is not shown, but is conventional. The single colinear feed is feasible because the system 20 uses multiple images or reflections in the slant screen 22 as shown in FIG. 4. In FIG. 4 the radiator or dipole 40 is shown in position relative to the screen 22 which causes there to be produced multiple image antennas 42. This eliminates overhanging or grate lobes in the vertical pattern.

As has been already pointed out above, there is a considerable advantage in that there are no active feed elements in the superstructure itself. Instead, all feed components are at a height of 0.2 wavelengths above the ground. The vertical angle of radiation can be steered by selecting the distance of the feed system from the apex of the screen 22 and the ground 38. Vertical angles from 8° to 22° may be selected for each and every frequency throughout the operating range of the array 20.

In FIG. 5 there is an illustration of typical vertical plane patterns for curtain, Rhombic and horizontal log periodic antennas. It will be noted that if the beam is set to a usable angle of 10° to 12° at the lowest frequency end of its range, then as the frequency is increased, the pattern becomes multilobed, it moves downwardly and its performance in gain and multipath interference deteriorates rapidly.

Furthermore, with the vertically polarized horizontal log periodic antennas of the prior art, as illustrated in FIG. 6, there is a substantial difficulty with respect to the reflection coefficient and the magnitude of the signal after it first contacts the ground. Both the magnitude and phase angle are distorted at the various frequencies illustrated by the curves in FIG. 6. In FIG. 6 there is assumed a vertical polarization conductivity 4mmmho and a dielectric constant 8 at the various frequencies of 5 through 30 mHz.

Figure 7:
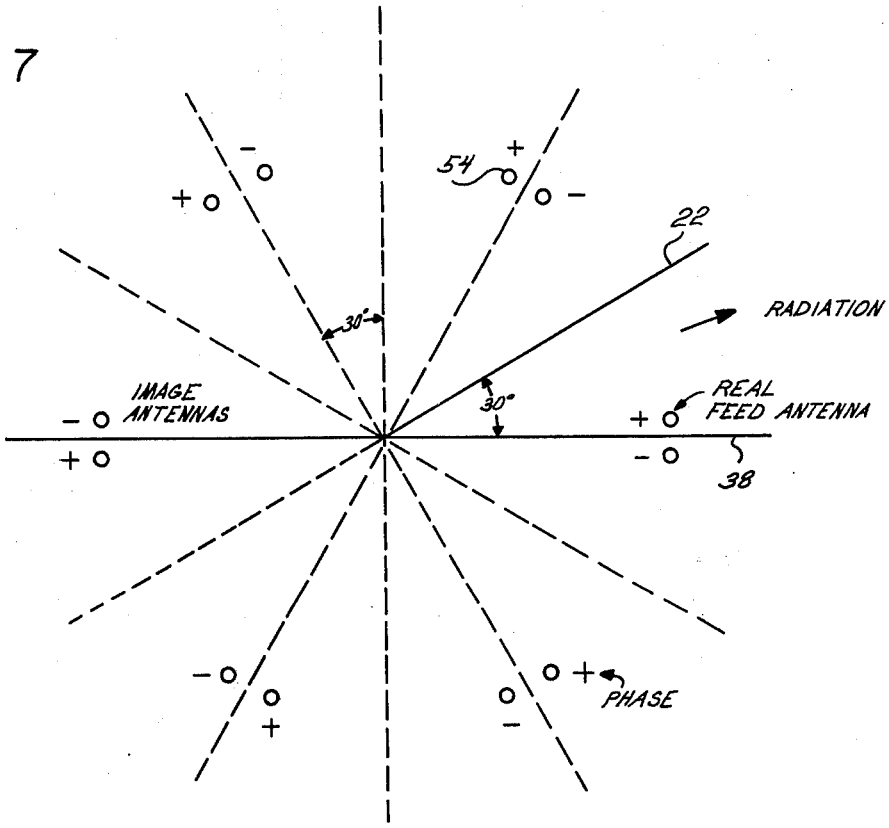
FIG. 7 is a diagram showing the radiating geometry for log sequential antennas having an apex angle of 30°.

In the system 20 described above in FIGS. 1, 2 and 3 there is a 45° angle included between the screen 22 and the ground 38. The radiating geometry of the antenna of this invention where the screen 22 is at an angle of 30°, is illustrated in FIG. 7. Note again that there are the multiple image antennas 54. The large arrow indicates the direction of the beam radiation.

Figure 8:
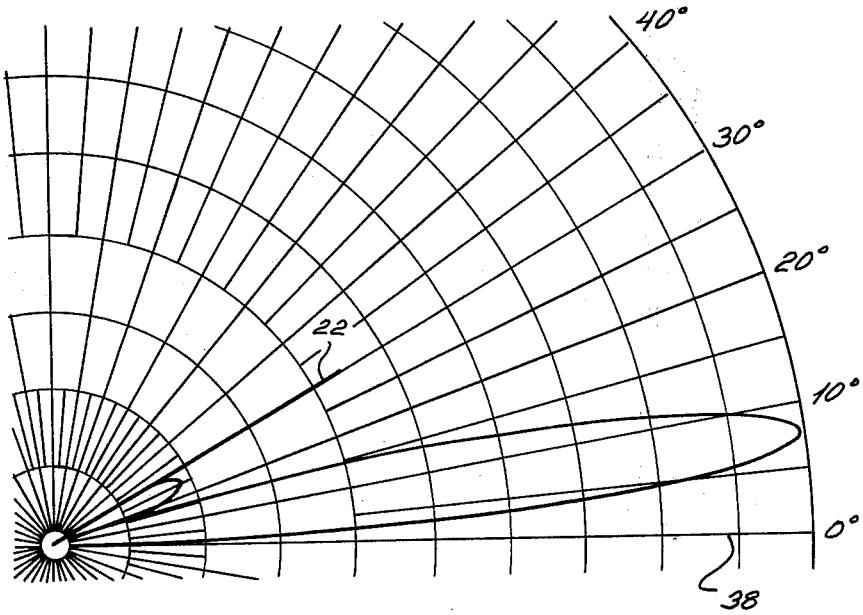
FIG. 8 is a typical radiation pattern for a log sequential antenna having a 30° apex angle of the screen with respect to the ground.

In FIG. 8, there is illustrated a typical radiation pattern for a log sequential antenna whose screen 22 is set at a 30° angle with respect to the ground 38. This figure should be compared with the patterns illustrated in FIG. 5 for the prior art antennas.

Figure 9:
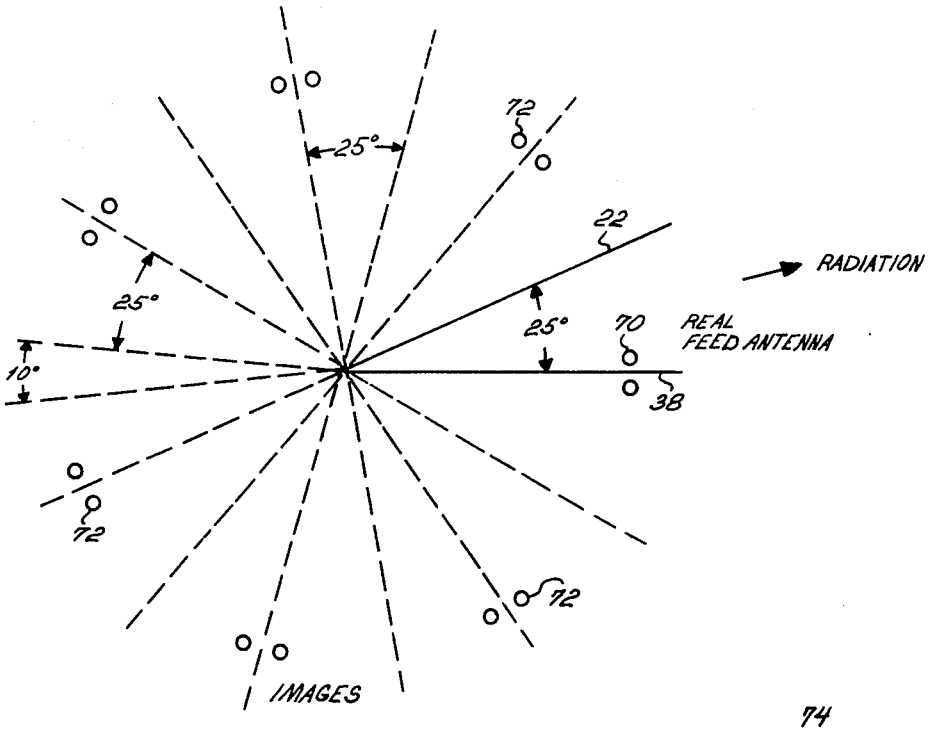
FIG. 9 is similar to FIG. 10, except that it indicates the radiating geometry of log sequential antenna whose reflector screen is set at 25° to the ground.

In FIG. 9, a similar radiation geometry diagram is presented for the log sequential antenna of this invention showing the screen 22 set at an angle of 25° with respect to the ground 38 with a feed antenna 70 positioned as illustrated which produces the multiple image antennas 72 as further illustrated. One indication here is that since the angle of 90° is not divided by a whole number, there is a residual wedge of 10° to the left side of the diagram as illustrated.

It should be noted that with smaller corner angles, the beam angle of radiation moves downwards towards the ground, which is most desirable for long distance propogation at high frequencies.

Figure 10:
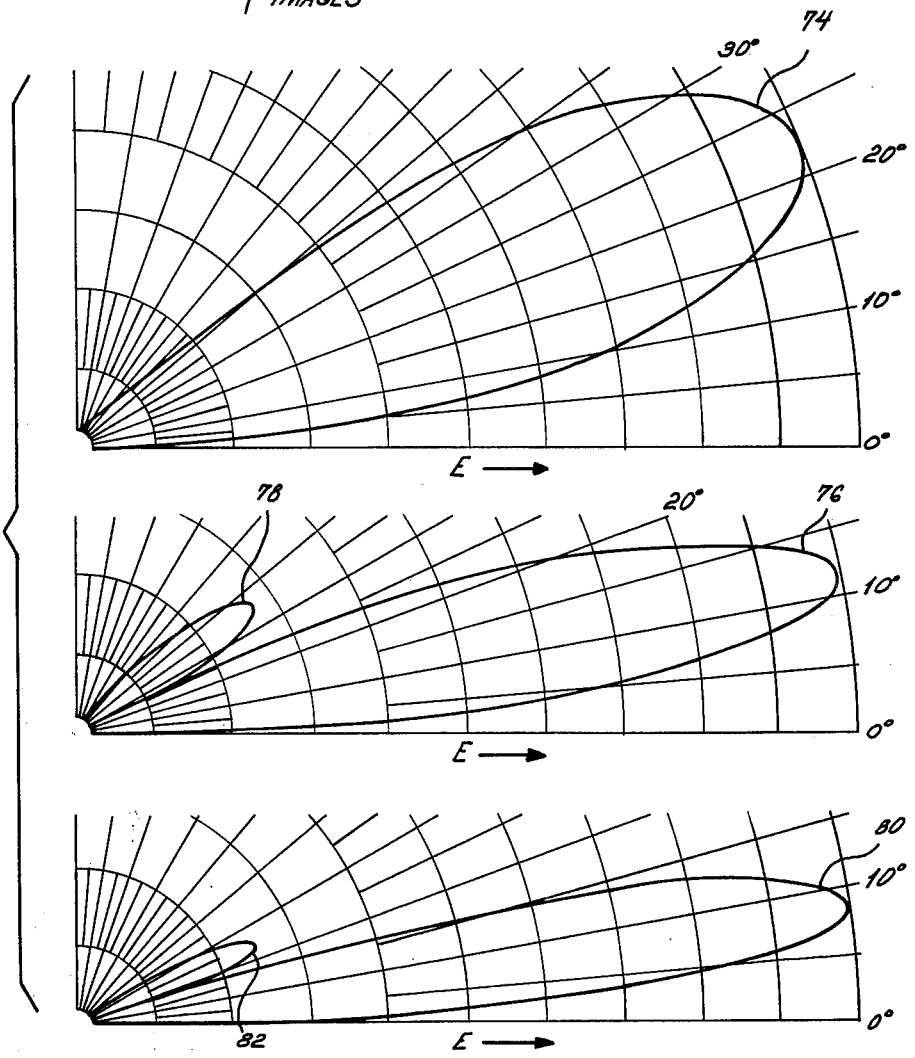
FIG. 10 shows available vertical plane patterns for log sequential antennas of 30°, 20° and 10°.

In FIG. 10, there are illustrated three available vertical plane patterns for the log sequential antenna of this invention. In the top one of the three diagrams, the lobe 74 illustrates the vertical pattern which can be achieved. In the middle diagram there is a main lobe 76 and also overhanging lobe 78. Similarly, in the bottom diagram, the main lobe 80 has a side lobe 82. The typical vertical and horizontal plane patterns as shown in FIG. 10 can be held constant from the lowest frequency design to any selected upper frequency limit.

Figure 11:
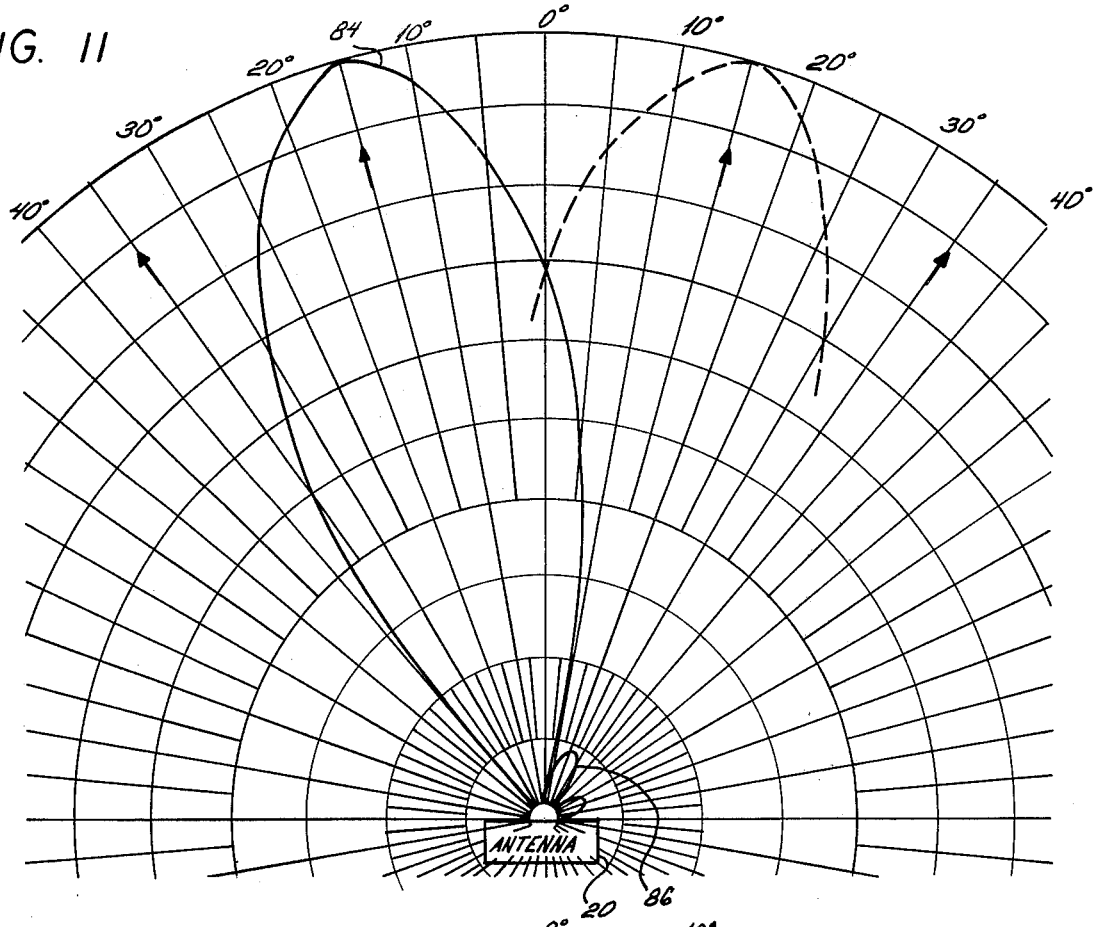
FIG. 11 shows a typical diagram illustrating the horizontal plane steerable patterns for medium gain log sequential antennas.

FIG. 11 illustrates a main lobe 84 proceeding from the log sequential antenna of this invention illustrated by the block 20 which produces a pair of side lobes 86. The horizontal plane pattern is steerable by phasing the feed system similar to the way steering is accomplished for curtain and multiple element log periodic arrays. With uniform power in all elements, both the antenna of this invention and a curtain antenna have equivalent steering. With tapered illumination they can be both steered to wide angles. As compared to log periodic arrays which have their subarrays converging inward to a point in front of the system, the log sequential antenna of this invention is much to be preferred since the subarrays of log periodic arrays are not aligned by bore-sight, the steering is restricted to smaller angles if the side lobes are to be kept within reasonable bounds.

Figure 12:
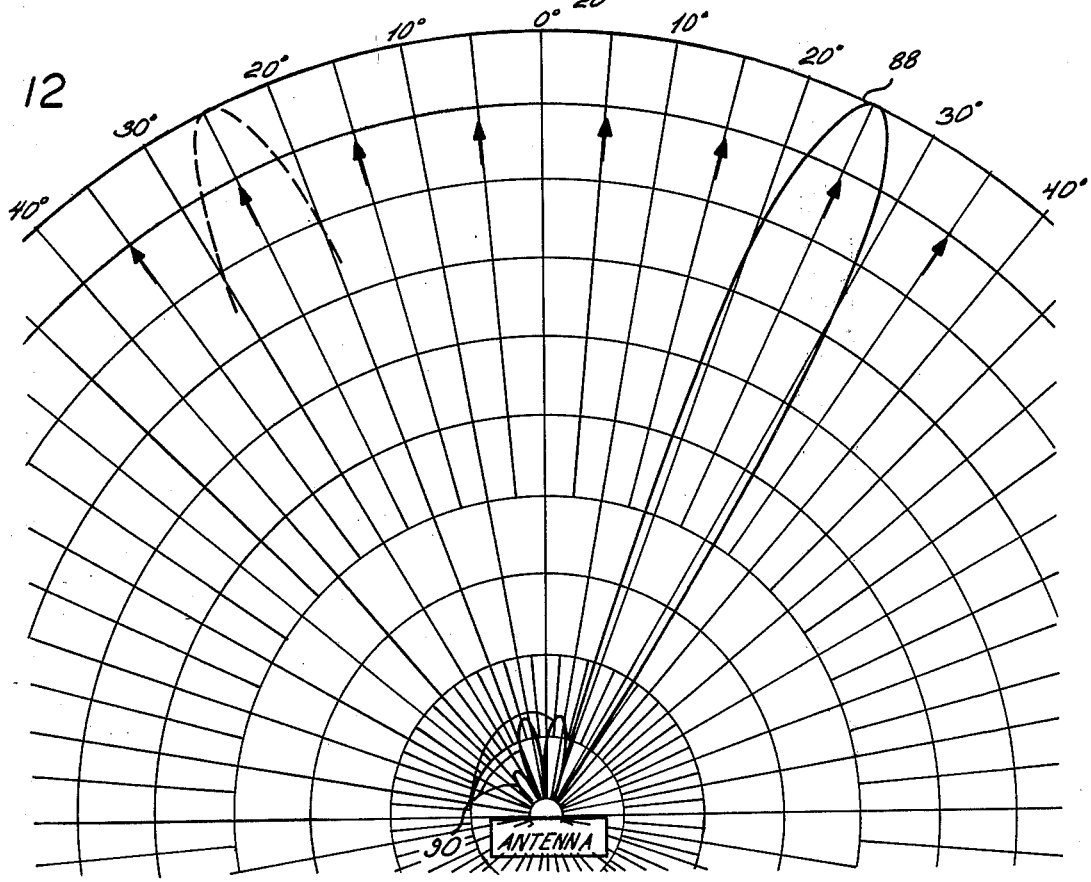
FIG. 12 is similar to FIG. 11 except that it shows the horizontal plane steerable patterns for high gain log sequential antennas.

FIG. 11 shows the horizontal plane steerable pattern for medium gain log sequential antenna of this invention and FIG. 12 shows a horizontal plane steerable pattern for a high gain log sequential antenna. In both FIGS. 11 and 12, the dotted line indicates the outer portion of the main lobe 84, 88 and the amount of steering that can be accomplished as described above.

As described above, by reconstructing all of the image antennas as illustrated in FIGS. 4, 7 and 9 as would be seen if the ground 38 and the screen 22 were perfectly reflecting surfaces, then the radiation is accurately calculated by adding the contributions of all the image antennas at their proper phase angles, an illustration of which is in FIG. 4. It becomes evident now that the screen 22 can be set at any angle and the radiation analyzed by repositioning of the images and their number. If the angle of 90° divided by an integer, the system of images is symmetrical, as shown in FIG. 4, otherwise there is a residual wedge angle at the rear, for example as shown in FIG. 9.

With smaller corner angles, the beam angle of radiation moves downward towards the ground which is most desirable for long distance propogation at high frequencies. This makes the log sequential antennas of this invention more useful than other prior art antennas because it suppresses high angle overhanging lobes of radiation which produce the multipath distortion or interference which is common on other types of antennas as illustrated in FIG. 5.

While the log sequential antenna of this invention has been described specifically in relation to the forms illustrated in the figures, it will be understood that men of skill in the art will be able to modify the basic structure without departing from the scope of the appended claims.

What is claimed is:

1. A log sequential antenna array for high frequency broadcasting and for communication systems comprising:
   a. a plurality of feed antennas;
   b. a single slanted reflector screen positioned above and overlying all of said feed antennas said slanted reflector screen having its lower end attached to the surface of the earth; and
   c. means for adjusting the angle between the screen and the ground from about 8° to 45° whereby said angle is adjustable for optimum performance at any given frequency for any given target area.

2. The log sequential antenna array of claim 1 wherein a plurality of feed antennas are center positioned under said screen and each of said feed antennas is positioned horizontally one wavelength from the juncture of said screen at the antenna operating frequency and the surface of the earth and each is vertically positioned 0.2 wavelengths above the surface of the earth at the antenna operating frequency.

3. A log sequential antenna of claim 2 wherein the width and length of said reflector screen is the minimum required for the lowest frequency of operation of any of said feed antennas.

4. The log sequential antenna of claim 2 wherein said feed antennas are spaced from one another by log periodic steps.

5. The log sequential antenna of claim 1 which further includes means for phasing said feed antennas whereby steering of the resulting horizontal plane radiation pattern can be achieved.

6. A log sequential antenna array for high frequency broad band broadcasting and communication systems comprising a plurality of separate feed antennas for radiating energy of different frequency bands, and a slanted reflector screen positioned above all of said separate feed antennas and having the lower end thereof connected to the surface of the earth, each of said separate feed antennas being spaced from the surface of the ground a distance equal to substantially 0.2 wave lengths at a frequency range of the respective feed antenna, each said feed antenna further being spaced horizontally from a juncture of said screen and said surface of said earth a distance equal to substantially one wave length in the frequency range of the respective antenna.

7. The log sequential antenna array of claim 6 wherein said feed antennas are separate die poles.

* * * * *